US011257406B2

(12) United States Patent
Hu et al.

(10) Patent No.: US 11,257,406 B2
(45) Date of Patent: Feb. 22, 2022

(54) AGING DETECTION CIRCUIT, AGING COMPENSATION CIRCUIT, DISPLAY PANEL AND AGING COMPENSATION METHOD

(71) Applicants: Hefei Xinsheng Optoelectronics Technology Co., Ltd., Anhui (CN); BOE Technology Group Co., Ltd., Beijing (CN)

(72) Inventors: Qi Hu, Beijing (CN); Hui Jing, Beijing (CN); Weijing Liao, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 90 days.

(21) Appl. No.: 16/618,241

(22) PCT Filed: May 13, 2019

(86) PCT No.: PCT/CN2019/086627
§ 371 (c)(1),
(2) Date: Nov. 29, 2019

(87) PCT Pub. No.: WO2019/218963
PCT Pub. Date: Nov. 21, 2019

(65) Prior Publication Data

US 2021/0158731 A1 May 27, 2021

(30) Foreign Application Priority Data

May 16, 2018 (CN) ..... 201810468880.3

(51) Int. Cl.
*G09G 3/3233* (2016.01)
*G09G 3/00* (2006.01)
*G09G 3/3275* (2016.01)

(52) U.S. Cl.
CPC ..... *G09G 3/006* (2013.01); *G09G 3/3233* (2013.01); *G09G 3/3275* (2013.01);
(Continued)

(58) Field of Classification Search
CPC .... G09G 3/006; G09G 3/3275; G09G 3/3233; G09G 2330/12; G09G 2310/08; G09G 2320/045
See application file for complete search history.

(56) References Cited

U.S. PATENT DOCUMENTS 7,479,937 B2 1/2009 Shimoda
9,424,770 B2 8/2016 Kim et al.
(Continued)

FOREIGN PATENT DOCUMENTS

CN 1614671 A 5/2005
CN 103854602 A 6/2014
(Continued)

OTHER PUBLICATIONS

First Office Action dated Dec. 4, 2019, for corresponding Chinese application 201810468880.3.

*Primary Examiner* — Jeff Piziali
(74) *Attorney, Agent, or Firm* — Nath, Goldberg & Meyer; Joshua B. Goldberg

(57) ABSTRACT

An aging detection circuit, an aging compensation circuit, a display panel, and an aging compensation method are provided. The aging detection circuit includes: a first current mirror circuit, a second current mirror circuit, a voltage converter and an analog-digital converter. An input terminal of the first current mirror circuit is electrically coupled to an initial reference voltage terminal and an anode of a to-be-detected light-emitting diode respectively, and an output terminal of the first current mirror circuit is electrically coupled to an input terminal of the second current mirror
(Continued)

circuit. An output terminal of the second current mirror circuit is electrically coupled to an input terminal of the voltage converter.

14 Claims, 3 Drawing Sheets

(52) U.S. Cl.
CPC ... *G09G 2310/08* (2013.01); *G09G 2320/045* (2013.01); *G09G 2330/12* (2013.01)

(56) References Cited

U.S. PATENT DOCUMENTS

| | | | | |
|---|---|---|---|---|
| 10,347,692 | B2 | 7/2019 | Lee et al. | |
| 2005/0104819 | A1* | 5/2005 | Shimoda | G09G 3/3283 345/76 |
| 2014/0152642 | A1* | 6/2014 | Kim | G09G 3/3208 345/212 |
| 2016/0163265 | A1* | 6/2016 | Yang | G09G 3/3233 345/690 |
| 2017/0046006 | A1* | 2/2017 | Kim | G09G 3/3266 |
| 2017/0162120 | A1 | 6/2017 | Hung et al. | |
| 2017/0294159 | A1* | 10/2017 | Lee | H01L 27/3248 |
| 2018/0114815 | A1* | 4/2018 | Lee | G09G 3/3291 |
| 2018/0254006 | A1* | 9/2018 | Hwang | G09G 3/3258 |

FOREIGN PATENT DOCUMENTS

| | | | |
|---|---|---|---|
| CN | 105590582 | A | 5/2016 |
| CN | 107146578 | A | 9/2017 |
| CN | 107633815 | A | 1/2018 |
| CN | 107978259 | A | 5/2018 |
| CN | 108615491 | A | 10/2018 |
| KR | 20120019741 | A | 3/2012 |

* cited by examiner

AGING DETECTION CIRCUIT, AGING COMPENSATION CIRCUIT, DISPLAY PANEL AND AGING COMPENSATION METHOD

This is a National Phase Application filed under 35 U.S.C. 371 as a national stage of PCT/CN2019/086627, filed May 13, 2019, an application claiming priority to Chinese patent application No. 201810468880.3, filed on May 16, 2018, the entire disclosure of each which is incorporated herein by reference.

TECHNICAL FIELD

The present disclosure relates to the field of display devices, and in particular, to an aging detection circuit, an aging compensation circuit including the aging detection circuit, a display panel including the aging compensation circuit, and an aging compensation method.

BACKGROUND

An organic light-emitting diode display panel may display images by controlling organic light-emitting diodes in pixel circuits to emit light. However, the organic light-emitting diode may age as time passes, thereby resulting in an increased voltage across a cathode and an anode of the organic light-emitting diode.

The voltage V across the cathode and anode of the organic light-emitting diode increases with the aging of the organic light-emitting diode, and a capacitance value of a parasitic capacitor $C_{oled}$ formed between the cathode and anode of the organic light-emitting diode remains unchanged, which results in an increased amount Q of charges stored in the parasitic capacitor $C_{oled}$ according to the formula $C_{oled} \cdot V = Q$, and in turn results in that the parasitic capacitor is charged first when the organic light-emitting diode is driven for display, and therefore the luminous brightness of the organic light-emitting diode may decrease.

SUMMARY

As a first aspect of the disclosure, an aging detection circuit is provided. The aging detection circuit includes a first current mirror circuit, a second current mirror circuit, a voltage converter, and an analog-to-digital converter. An input terminal of the first current mirror circuit is electrically coupled to an initial reference voltage terminal and an anode of a to-be-detected light-emitting diode respectively, an output terminal of the first current mirror circuit is electrically coupled to an input terminal of the second current mirror circuit, and a power input terminal of the first current mirror circuit is electrically coupled to a first reference voltage terminal. An output terminal of the second current mirror circuit is electrically coupled to an input terminal of the voltage converter, and a power input terminal of the second current mirror circuit is electrically coupled to a third reference voltage terminal, one of the first current mirror circuit and the second current mirror circuit is an N-type current mirror circuit, and the other of the first current mirror circuit and the second current mirror circuit is a P-type current mirror circuit. The voltage converter is configured to convert a current output from the second current mirror circuit into a voltage and output the voltage. The analog-to-digital converter is configured to convert the voltage signal output from the voltage converter into a digital signal.

In an embodiment, an initial switch is provided between the input terminal of the first current mirror circuit and the initial reference voltage terminal.

In an embodiment, the first reference voltage terminal is a ground terminal, the third reference voltage terminal is a voltage terminal that provides a voltage higher than a voltage of the first reference voltage terminal, the first current mirror circuit is an N-type current mirror circuit, and the second current mirror circuit is a P-type current mirror circuit.

In an embodiment, the voltage converter includes an integration circuit, a second switch, a second capacitor, and a third switch. The integration circuit includes an amplifier, a first capacitor and a first switch. An inverting input terminal of the amplifier serves as the input terminal of the voltage converter, and a non-inverting input terminal of the amplifier is coupled to a second reference voltage terminal. One terminal of the first capacitor is coupled to the inverting input terminal of the amplifier, and the other terminal of the first capacitor is coupled to an output terminal of the amplifier. One terminal of the first switch is electrically coupled to the one terminal of the first capacitor, and the other terminal of the first switch is electrically coupled to the other terminal of the first capacitor. One terminal of the second capacitor is coupled between the second switch and the third switch, and the other terminal of the second capacitor is electrically coupled to the first reference voltage terminal. One terminal of the third switch is coupled to the second switch and the second capacitor, and the other terminal of the third switch serves as an output terminal of the voltage converter.

In an embodiment, the first current mirror circuit comprises a first N-type current mirror transistor and a second N-type current mirror transistor. A gate electrode of the first N-type current mirror transistor is electrically coupled to a gate electrode of the second N-type current mirror transistor, a first electrode of the first N-type current mirror transistor serves as an input terminal of the aging detection circuit, a second electrode of the first N-type current mirror circuit serves as the power input terminal of the first current mirror circuit, and the first electrode of the first N-type current mirror transistor is electrically coupled to the gate electrode of the first transistor. A first electrode of the second N-type current mirror transistor serves as the output terminal of the first current mirror circuit, and a second electrode of the second N-type current mirror transistor is electrically coupled to the second electrode of the first N-type current mirror transistor.

In an embodiment, the second current mirror circuit includes a first P-type current mirror transistor and a second P-type current mirror transistor. A gate electrode of the first P-type current mirror transistor is electrically coupled to a gate electrode of the second P-type current mirror transistor, a first electrode of the first P-type current mirror transistor serves as the input terminal of the second current mirror circuit, a second electrode of the first P-type current mirror transistor serves as the power input terminal of the second current mirror circuit, and the first electrode of the first P-type current mirror transistor is electrically coupled to the gate electrode of the first P-type current mirror transistor. A first electrode of the second P-type current mirror transistor serves as the output terminal of the second current mirror circuit, and a second electrode of the second P-type current mirror transistor is electrically coupled to the second electrode of the first P-type current mirror transistor.

In an embodiment, the second current mirror circuit includes a first P-type current mirror transistor, a second P-type current mirror transistor, a third P-type current mirror transistor, and a fourth P-type current mirror transistor. A gate electrode of the first P-type current mirror transistor is electrically coupled to a gate electrode of the second P-type current mirror transistor, a first electrode of the first P-type current mirror transistor is electrically coupled to a first electrode of the third P-type current mirror transistor, a second electrode of the first P-type current mirror transistor serves as the power input terminal of the second current mirror circuit, and the gate electrode of the first P-type current mirror transistor is electrically coupled to the first electrode of the first P-type current mirror transistor. A first electrode of the second P-type current mirror transistor is electrically coupled to a first electrode of the fourth P-type current mirror transistor, and a second electrode of the second P-type current mirror transistor is electrically coupled to the second electrode of the first P-type current mirror transistor. A gate electrode of the third P-type current mirror transistor is electrically coupled to a gate electrode of the fourth P-type current mirror transistor, a second electrode of the third P-type current mirror transistor serves as the input terminal of the second current mirror circuit, and the gate electrode of the third P-type current mirror transistor is electrically coupled to the second electrode of the third P-type current mirror transistor. A second electrode of the fourth P-type current mirror circuit serves as the output terminal of the second current mirror circuit.

As a second aspect of the disclosure, an aging compensation circuit is provided. The aging compensation circuit includes a compensation value calculation circuit and an aging detection circuit above. An output terminal of the analog-to-digital converter in the aging detection circuit is electrically coupled to the compensation value calculation circuit. The compensation value calculation circuit is configured to determine and output a data voltage compensation value.

In an embodiment, the compensation value calculation circuit includes a compensation value calculation sub-circuit and a timer. An input terminal of the timer serves as an input terminal of the compensation value calculation circuit, and an output terminal of the timer is electrically coupled to an input terminal of the compensation value calculation sub-circuit. An output of the analog-to-digital converter is transmitted to the compensation value calculation sub-circuit upon expiration of a time set in the timer. The compensation value calculation sub-circuit is configured to determine the data voltage compensation value according to the digital signal output from the analog-to-digital converter upon expiration of the time set in the timer, and output the data voltage compensation value.

As a third aspect of the disclosure, a display panel is provided. The display panel includes a plurality of pixel circuits arranged in multiple rows and multiple columns and a source driving circuit. The display panel further includes: scan gate lines, in one-to-one correspondence with the multiple rows of pixel circuits respectively, each of the scan gate lines being electrically coupled to switch transistors in pixel circuits in a corresponding row; detection gate lines, in one-to-one correspondence with the multiple rows of pixel circuits respectively; detection output lines, in one-to-one correspondence with the multiple columns of pixel circuits respectively; detection controllers, in one-to-one correspondence with the plurality of pixel circuits respectively, wherein a control terminal of the detection controller is electrically coupled to a corresponding detection gate line, an input terminal of the detection controller is electrically coupled to an anode of a light-emitting diode in a corresponding pixel circuit, an output terminal of the detection controller is electrically coupled to a corresponding detection output line, and the detection controller is configured to be turned on upon receipt of a first detection control signal; and aging compensation circuits, in one-to-one correspondence with the multiple columns of pixel circuits respectively, wherein each of the aging compensation circuits is the aging compensation circuit above, an output terminal of the aging compensation circuit is electrically coupled to the source driving circuit of the display panel, and the input terminal of the first current mirror circuit of the aging compensation circuit is electrically coupled to a corresponding detection output line, wherein the source driving circuit is configured to combine data voltage compensation values corresponding to the plurality of pixel circuits with corresponding uncompensated data voltages, and provide compensated data voltages to the plurality of pixel circuits respectively.

In an embodiment, the detection controller includes a detection control transistor, a gate electrode of the detection control transistor serves as the control terminal of the detection controller, a first electrode of the detection control transistor serves as the input terminal of the detection controller, and a second electrode of the detection control transistor serves as the output terminal of the detection controller. The detection control transistor is turned on when the gate electrode of the detection control transistor receives a first detection control signal, and the detection control transistor is turned off when the gate electrode of the detection control transistor receives a second detection control signal having a phase opposite to a phase of the first detection control signal, and the switch transistors are turned on when a first scan signal is received, and the switch transistors are turned off when a second scan signal having a phase opposite to a phase of the first scan signal is received.

As a fourth aspect of the disclosure, an aging compensation method is provided. The aging compensation method includes: during a reset stage, turning on an initial switch, applying a first scan signal to a scan gate line, and applying a first detection control signal to a detection gate line so as to reset an anode of an organic light-emitting diode; during a detection stage, turning off the initial switch, providing the first scan signal to the scan gate line, applying a data voltage to a data line, and applying the first detection control signal to the detection gate line, so that an aging detection circuit performs detection and provides a digital signal output from an analog-to-digital converter in the aging detection circuit to a compensation value calculation circuit; and during a compensation stage, determining, by the compensation value calculation circuit, a data voltage compensation value and outputting the data voltage compensation value to a source driving circuit, and applying, by the source driving circuit, a compensated data voltage to the pixel circuit.

In an embodiment, the aging compensation method further includes: during the reset stage, turning on the first switch, and turning off both of the second switch and the third switch; and after the anode is reset, applying a second scan signal having a phase opposite to a phase of the first scan signal to the scan gate line, and applying a second detection control signal having a phase opposite to a phase of the first detection control signal to the detection gate line.

In an embodiment, the aging compensation method further includes: during the detection stage, turning off the first switch, and turning on both of the second switch and third switch.

In an embodiment, the aging compensation method further includes: during the compensation stage, determining, by the compensation value calculation circuit, the data voltage compensation value according to the digital signal output from the analog-to-digital converter upon expiration of a time set in of a timer; and combining, by the source driving circuit, the data voltage compensation value with an uncompensated data voltage to provide a compensated data voltage to the pixel circuit.

BRIEF DESCRIPTION OF THE DRAWINGS

The accompanying drawings, which provide a further understanding of the disclosure and constitute a part of the specification, are used in conjunction with the following specific embodiments to explain the disclosure, but are not intended to limit the disclosure. In the drawings.

DETAILED DESCRIPTION

Figure 1:
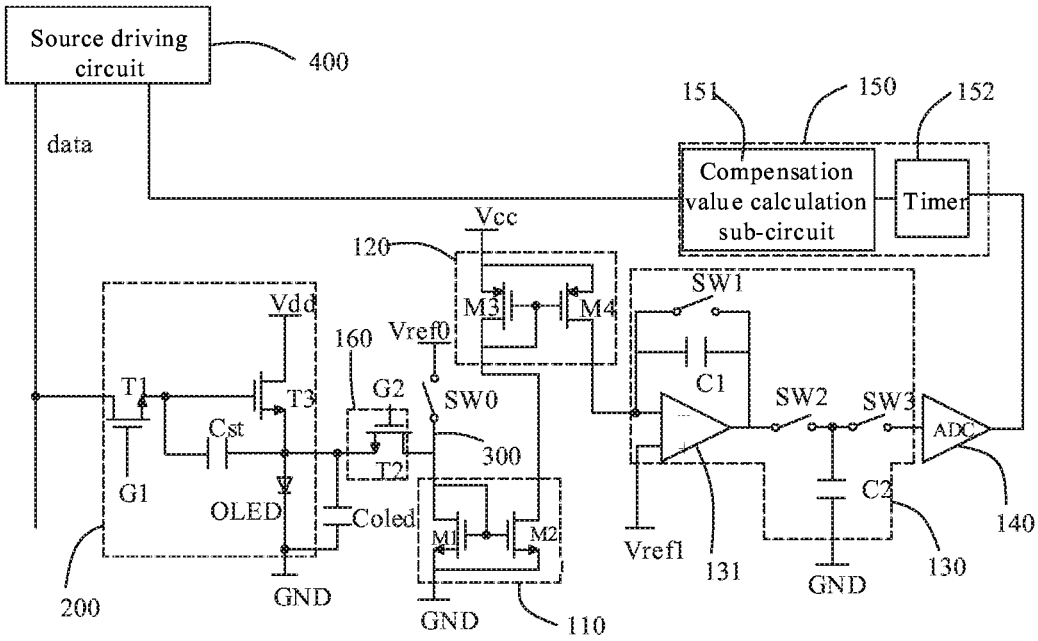
FIG. 1 is a schematic diagram showing a scenario in which an aging compensation circuit according to an embodiment of the disclosure cooperates with a pixel circuit.

Exemplary embodiments of the disclosure will be described in detail below with reference to the accompanying drawings. It is to be understood that the embodiments described herein are merely for describing and explaining the disclosure rather than limiting the disclosure.

As a first aspect, an aging detection circuit is provided in the present disclosure. The aging detection circuit includes a first current mirror circuit 110, a second current mirror circuit 120, a voltage converter 130, and an analog-to-digital converter 140.

An input terminal of the first current mirror circuit 110 is electrically coupled to an initial reference voltage terminal Vref0 and an anode of a to-be-detected light-emitting diode OLED. An output terminal of the first current mirror circuit 110 is electrically coupled to an input terminal of the second current mirror circuit 120. A power input terminal of the first current mirror circuit 110 is electrically coupled to a first reference voltage terminal.

An output terminal of the second current mirror circuit 120 is electrically coupled to an input terminal of the voltage converter 130. A power input terminal of the second current mirror circuit 120 is electrically coupled to a third reference voltage terminal. One of the first current mirror circuit 110 and the second current mirror circuit 120 is an N-type current mirror circuit, and the other of the first current mirror circuit 110 and the second current mirror circuit 120 is a P-type current mirror circuit.

The voltage converter 130 is configured to convert a current output from the second current mirror circuit 120 into a voltage and output the converted voltage. The analog-to-digital converter 140 is configured to convert the voltage signal output from the voltage converter 130 into a digital signal.

It is easily understood that the current mirror circuit includes at least one pair of transistors. By controlling width-to-length ratios of transistors in the current mirror circuit, a current output from an output terminal of the current mirror circuit can be larger than a current input into an input terminal of the current mirror circuit. That is, the current mirror circuit may serve as a current amplifying device.

In the disclosure, one of the first current mirror circuit 110 and the second current mirror circuit 120 is an N-type current mirror circuit, and the other of the first current mirror circuit 110 and the second current mirror circuit 120 is a P-type current mirror circuit, ensuring that a voltage difference is generated in the aging detection circuit so as to generate a current. In an embodiment, the first reference voltage terminal may be a ground terminal GND, and the third reference voltage terminal may be a voltage terminal Vcc that provides a voltage higher than a voltage of the first reference voltage terminal. In this embodiment, the first current mirror circuit 110 is an N-type current mirror circuit and the second current mirror circuit 120 is a P-type current mirror circuit, so as to ensure that a closed loop is formed in the aging detection circuit. For example, all transistors in the first current mirror circuit 110 may be N-type transistors, and all transistors in the second current mirror circuit 120 may be P-type transistors.

Although an example in which the first reference voltage terminal is a ground terminal and the third reference voltage terminal is a voltage terminal that provides a voltage higher than a voltage of the first reference voltage terminal is shown and described below, it should be understood that the first reference voltage terminal is interchangeable with the third reference voltage terminal, and in the case of interchange, the types (e.g., N-type, P-type) of the first current mirror circuit and the second current mirror circuit may be interchanged.

The aging detection circuit according to the disclosure can detect an aging degree of the light-emitting diode OLED in the pixel circuit 200. The detection process may include a reset stage and a detection stage. During the reset stage, the input terminal of the first current mirror circuit 110 is electrically coupled to the initial reference voltage terminal Vref0 to reset the anode of the organic light-emitting diode.

During the detection stage, the input terminal of the first current mirror circuit 110 is disconnected from the initial reference voltage terminal Vref0, and is electrically coupled to the anode of the light-emitting diode OLED. At this time, a data voltage is provided to a pixel circuit 200 where the to-be-detected light-emitting diode OLED is located, and the pixel circuit 200 generates a driving current for driving the light-emitting diode OLED to emit light. The driving current charges the parasitic capacitor $C_{oled}$ of the light-emitting diode OLED to generate a charging current, which serves as an input current of the first current mirror circuit 110.

The first current mirror circuit 110 amplifies the input current and outputs the amplified current to the second current mirror circuit 120. The second current mirror circuit 120 is electrically coupled to the voltage terminal Vcc which may power the first current mirror circuit 110 and the second current mirror circuit 120. A current output from the second current mirror circuit 120 may be transmitted to the voltage converter 130. The voltage converter 130 converts the current signal output from the second current mirror circuit 120 into a voltage signal. The analog-to-digital converter 140 may convert the voltage signal output from the voltage converter 130 into a digital signal.

As described above, the current input to the first current mirror circuit 110 is the charging current generated when the parasitic capacitor $C_{oled}$ formed between the anode and cathode of the light-emitting diode OLED is charged. The larger the charging current, the more charges it requires to fully charge the parasitic capacitor $C_{oled}$. Thus, the aging degree of the light-emitting diode can be determined by detecting the charging current of the parasitic capacitor of the light-emitting diode. In the present disclosure, the first current mirror circuit 110 amplifies the charging current, since the amplified charging current is more easily detected. Thus, the aging detection circuit according to the present disclosure can accurately detect the charging current of the parasitic capacitor $C_{oled}$, convert the charging current into a digital signal, and quantitatively evaluate the aging degree of the light-emitting diode OLED according to the obtained digital signal, which is beneficial to better monitoring the aging degree of the light-emitting diode OLED.

The aging detection circuit according to the present disclosure is selectively electrically coupled to the initial reference voltage terminal Vref0. For example, an initial switch SW0 may be provided between the input terminal of the first current mirror circuit 110 and the initial reference voltage terminal Vref0. Whether the first current mirror circuit 110 is electrically coupled to the initial reference voltage terminal Vref0 or not may be controlled by the initial switch SW0.

In the present disclosure, the voltage converter 130 may include an integration circuit, a second switch SW2, a second capacitor C2, and a third switch SW3.

In an embodiment, the integration circuit may include an amplifier 131, a first capacitor C1, and a first switch SW1. An inverting input terminal of the amplifier 131 serves as the input terminal of the voltage converter 130, and a non-inverting input terminal of the amplifier 131 is coupled to a second reference voltage terminal Vref1. One terminal of the first capacitor C1 is coupled to the inverting input terminal of the amplifier 131, and the other terminal of the first capacitor C1 is coupled to an output terminal of the amplifier 131. One terminal of the first switch SW1 is electrically coupled to the one terminal of the first capacitor C1, and the other terminal of the first switch SW1 is electrically coupled to the other terminal of the first capacitor C1. The second switch SW2 is provided between the output terminal of the amplifier 131 and one terminal of the second capacitor C2.

Figure 2:
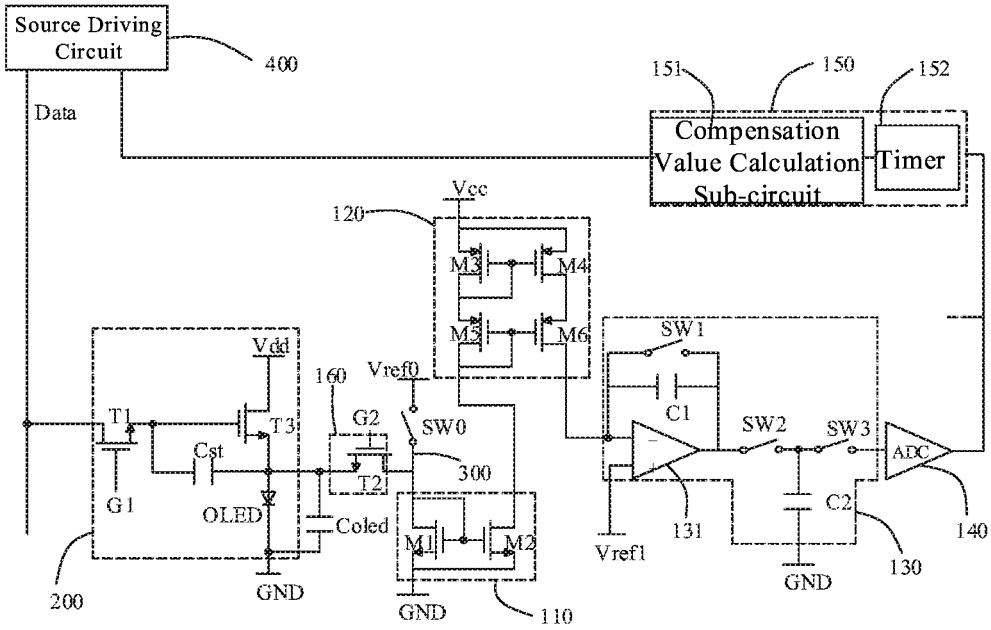
FIG. 2 is a schematic diagram showing a scenario in which an aging compensation circuit according to another embodiment of the disclosure cooperates with a pixel circuit.

The one terminal of the second capacitor C2 is coupled between the second switch SW2 and the third switch SW3, and the other terminal of the second capacitor C2 is electrically coupled to the first reference voltage terminal (in FIGS. 1 and 2, the first reference voltage terminal is the ground terminal GND).

One terminal of the third switch SW3 is coupled to the second switch SW2 and the second capacitor C2 respectively, and the other terminal of the third switch SW3 serves as an output terminal of the voltage converter 130.

During the detection stage, both of the second switch SW2 and the third switch SW3 are turned on, and the first switch SW1 is turned off. During a non-detection stage, both of the first switch SW1 and the third switch SW3 are turned off, and the second switch SW2 is turned on. In the present disclosure, with the first switch SW1, the second switch SW2, and the third switch SW3, a loop circuit can be prevented from being formed in the aging detection circuit during the non-detection stage, and in turn, a leakage current and the like resulted from the loop circuit can be prevented.

In the voltage converter circuit 130 described above, the integration circuit may reflect a change in voltage across the first capacitor C1 at the two terminals of the second capacitor C2 in a manner of capacitive coupling, and convert the input current signal into a voltage signal through a coupling effect and output the converted voltage signal.

In the present disclosure, detailed structures of the first switch SW1, the second switch SW2, and the third switch SW3 are not particularly limited here. For example, each of the first switch SW1, the second switch SW2, and the third switch SW3 may be a thin film transistor. The first switch SW1, the second switch SW2, and the third switch SW3 may be controlled by applying a gate signal to gate electrodes of the first switch SW1, the second switch SW2, and third switch SW3 respectively.

As described above, the first current mirror circuit 110 may be an N-type current mirror circuit. In the embodiments shown in FIGS. 1 and 2, the first current mirror circuit 110 includes a first N-type current mirror transistor M1 and a second N-type current mirror transistor M2.

In an embodiment, a gate electrode of the first N-type current mirror transistor M1 is electrically coupled to a gate electrode of the second N-type current mirror transistor M2. A first electrode of the first N-type current mirror transistor M1 serves as an input terminal of the aging detection circuit. A second electrode of the first N-type current mirror transistor M1 serves as the power input terminal of the first current mirror circuit 110, and is electrically coupled to the first reference voltage terminal (i.e., the ground terminal GND in FIGS. 1 and 2). The first electrode of the first N-type current mirror transistor M1 is electrically coupled to the gate electrode of the first N-type current mirror transistor M1.

A first electrode of the second N-type current mirror transistor M2 serves as the output terminal of the first current mirror circuit 110, and a second electrode of the second N-type current mirror transistor M2 is electrically coupled to the second electrode of the first N-type current mirror transistor M1.

It should be understood that "first electrode" and "second electrode" herein refer to a source electrode and/or drain electrode of a transistor. Whether "the first electrode" and "the second electrode" refer to the source electrode or the drain electrode can be determined according to the drawings and the circuit connections therein. It should be understood that the "first electrode" and "second electrode" may also be interchanged adaptively in a case where the types of first and second current mirror circuits are interchanged.

As shown in FIG. 1, when the parasitic capacitor $C_{oled}$ of the light-emitting diode OLED is charged, the charging current flows into the first current mirror circuit 110 including the first N-type current mirror transistor M1 and the second N-type current mirror transistor M2. In the present disclosure, a current output from the first current mirror circuit 110 is larger than a current input to the first current mirror circuit 110 by controlling a width-to-length ratio of the first N-type current mirror transistor M1 and a width-to-length ratio of the second N-type current mirror transistor M2.

In the present disclosure, the structure of the second current mirror circuit 120 is not particularly limited here. For example, in the embodiment shown in FIG. 1, the second current mirror circuit 120 may include a first P-type current mirror transistor M3 and a second P-type current mirror transistor M4.

A gate electrode of the first P-type current mirror transistor M3 is electrically coupled to a gate electrode of the second P-type current mirror transistor M4, and a first electrode of the first P-type current mirror transistor M3 serves as the input terminal of the second current mirror circuit 120. A second electrode of the first P-type current mirror transistor M3 serves as the power input terminal of the second current mirror circuit 120 and is electrically coupled to the voltage terminal Vcc. The first electrode of the first P-type current mirror transistor M3 is electrically coupled to the gate electrode of the first P-type current mirror transistor M3.

A first electrode of the second P-type current mirror transistor M4 serves as the output terminal of the second current mirror circuit 120, and a second electrode of the second P-type current mirror transistor M4 is electrically coupled to the second electrode of the first P-type current mirror transistor M3.

The voltage terminal Vcc may simultaneously power the first current mirror circuit 110 and the second current mirror circuit 120.

In the embodiment shown in FIG. 1, a current output to the first capacitor C1 and a current for charging the parasitic capacitor $C_{oled}$ satisfy the following equation:

$$\frac{I_{oled}}{I_{C1}} = \frac{(W/L)_1}{(W/L)_2} \times \frac{(W/L)_3}{(W/L)_4},$$

Where $I_{oled}$ is the current for charging the parasitic capacitor $C_{oled}$, $I_{C1}$ is a current (referred to as a detection current) flowing through the first capacitor C1, $(W/L)_1$ is a width-to-length ratio of the first N-type current mirror transistor, $(W/L)_2$ is a width-to-length ratio of the second N-type current mirror transistor, $(W/L)_3$ is a width-to-length ratio of the first P-type current mirror transistor, and $(W/L)_4$ is a width-to-length ratio of the second P-type current mirror transistor. By controlling the width-to-length ratios of the transistors, detection currents with different amplification magnifications can be obtained.

In the embodiment shown in FIG. 2, the second current mirror circuit 120 includes a first P-type current mirror transistor M3, a second P-type current mirror transistor M4, a third P-type current mirror transistor M5, and a fourth P-type current mirror transistor M6.

In the embodiment, a current mirror including the first P-type current mirror transistor M3 and the second P-type current mirror transistor M4 is coupled in series with a current mirror including the third P-type current mirror transistor M5 and the fourth P-type current mirror transistor M6.

In an embodiment, a gate electrode of the first P-type current mirror transistor M3 is electrically coupled to a gate electrode of the second P-type current mirror transistor M4. A first electrode of the first P-type current mirror transistor M3 is electrically coupled to a first electrode of the third P-type current mirror transistor M5. A second electrode of the first P-type current mirror transistor M3 serves as the power input terminal of the second current mirror circuit 120 and is electrically coupled to the voltage terminal Vcc. The gate electrode of the first P-type current mirror transistor M3 is electrically coupled to the first electrode of the first P-type current mirror transistor M3.

A first electrode of the second P-type current mirror transistor M4 is electrically coupled to a first electrode of the fourth P-type current mirror transistor M6. A second electrode of the second P-type current mirror transistor M4 is electrically coupled to the second electrode of the first P-type current mirror transistor M3.

A gate electrode of the third P-type current mirror transistor M5 is electrically coupled to the gate electrode of the fourth P-type current mirror transistor M6. A second electrode of the third P-type current mirror transistor M5 serves as the input terminal of the second current mirror circuit 120. A gate electrode of the third P-type current mirror transistor M5 is electrically coupled to the second electrode of the third P-type current mirror transistor M5.

A second electrode of the fourth P-type current mirror transistor M6 serves as the output terminal of the second current mirror circuit 120.

In the present disclosure, the current mirror including the third P-type current mirror transistor M5 and the fourth P-type current mirror transistor M6 can stabilize a current output from the current mirror including the first P-type current mirror transistor M3 and the second P-type current mirror transistor M4, thereby preventing an error of the current from being amplified, and obtaining a more accurate detection result.

As a second aspect of the present disclosure, an aging compensation circuit is provided. As shown in FIGS. 1 and 2, the aging compensation circuit includes an aging detection circuit according to the above embodiments and implementations of the present disclosure and a compensation value calculation circuit 150. An output terminal of the analog-to-digital converter 140 of the aging detection circuit is electrically coupled to the compensation value calculation circuit 150. The compensation value calculation circuit 150 is configured to determine and output a data voltage compensation value.

In an embodiment, the compensation value calculation circuit 150 may output the compensation value for the data voltage to the source driving circuit 400. The source driving circuit 400 may combine the data voltage compensation value with the uncompensated data voltage to provide the compensated data voltage. The light-emitting diode OLED in the pixel circuit 200 is driven to emit light by using the compensated data voltage, and therefore the problem that the brightness of the light-emitting diode display panel decreases as the usage time increases can be solved.

Assuming that the aging compensation circuit operates for the first time, a data voltage before the present compensation is an initial data voltage. Assuming that the aging compensation circuit operates for the second time, a data voltage before the present compensation is the data voltage subjected to the first aging compensation, and so on. A data voltage before the $n^{th}$ compensation is the data voltage subjected to the $(N-1)^{th}$ compensation.

In the present disclosure, the structure of the compensation value calculation circuit 150 is not particularly limited here. For example, in an embodiment, the compensation value calculation circuit 150 may include a compensation value calculation sub-circuit 151 and a timer 152.

An input terminal of the timer 152 may serve as an input terminal of the compensation value calculation circuit 150, an output terminal of the timer 152 is electrically coupled to an input terminal of the compensation value calculation sub-circuit 151. An output from the analog-to-digital converter 140 is transmitted to the compensation value calculation sub-circuit 151 upon expiration of a time set in the timer 152.

The compensation value calculation sub-circuit 151 may be configured to determine the data voltage compensation value according to the digital signal output from the analog-to-digital converter 140 upon expiration of the time set in the timer 152, and output the data voltage compensation value.

Since the aging of the light-emitting diode gradually is aggravated as the usage time increases, it is necessary to retest the aging degree of the light-emitting diode OLED and re-determine the data voltage compensation value at intervals. In the present disclosure, the aging degree of the light-emitting diode OLED in the pixel circuit 200 can be periodically detected by using the timer 152.

Figure 3:
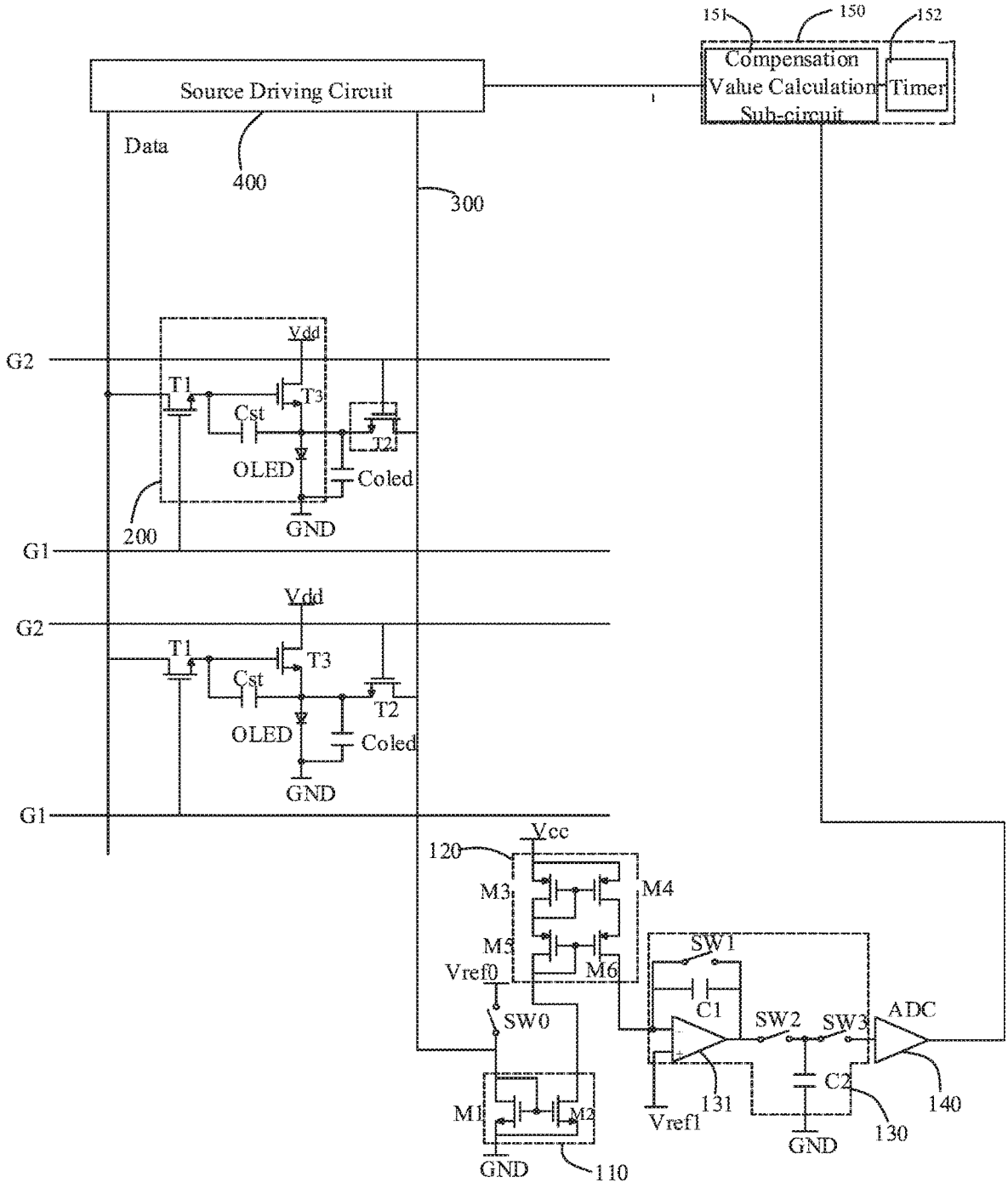
FIG. 3 is a schematic diagram showing a structure of a portion of a display panel according to the disclosure.

As a third aspect of the present disclosure, a display panel is provided. As shown in FIG. 3, the display panel includes a plurality of pixel circuits 200 arranged in multiple rows and multiple columns, and a source driving circuit 400. The display panel further includes scan gate lines G1, detection gate lines G2, detection output lines 300, detection controllers 160, and the aging compensation circuits according to any one of the above embodiments and implementations of the present disclosure.

The scan gate lines G1 are in one-to-one correspondence with the multiple rows of pixel circuits respectively. Each of the scan gate lines G1 is coupled to transistors T1 of the pixel circuits in each row.

The detection gate lines G2 are in one-to-one correspondence with the multiple rows of pixel circuits respectively.

The detection output lines 300 are in one-to-one correspondence with the multiple columns of pixel circuits respectively. It should be understood that the detection output lines 300 are not shown in FIGS. 1 and 2, but the detection output lines 300 may also be provided in the embodiments and implementations shown in FIGS. 1 and 2.

The detection controllers 160 are in one-to-one correspondence with the plurality of pixel circuits 200 respectively. A control terminal of each of the detection controllers 160 is electrically coupled to a corresponding detection gate line G2. An input terminal of each of the detection controllers 160 is electrically coupled to an anode of a light-emitting diode OLED in a corresponding pixel circuit 200. An output terminal of each of the detection controllers 160 is electrically coupled to a corresponding detection output line 300. The detection controller 160 is configured to be turned on when a first detection control signal is received.

The aging compensation circuits are in one-to-one correspondence with the multiple columns of pixel circuits 200 respectively. An input terminal of a first current mirror circuit in each of the aging compensation circuits is electrically coupled to a corresponding detection output line, and an output terminal of each of the aging compensation circuits is electrically coupled to the source driving circuit 400 of the display panel.

The source driving circuit 400 is configured to combine compensation values for data voltages corresponding to the plurality of pixel circuits 200 with corresponding data voltages respectively, and provide the compensated data voltages to the plurality of pixel circuits 200 respectively.

In the present disclosure, each column of pixel circuits 200 corresponds to one aging compensation circuit. The aging detection circuit in one aging compensation circuit may detect the organic light-emitting diodes OLED in a corresponding column of pixel circuits 200, so that the aging compensation circuit may calculate the compensation values for the data voltages of all the light-emitting diodes OLED in the corresponding column of pixel circuits 200. Accordingly, the compensation values for the data voltages of the light-emitting diodes OLED in all the pixel circuits 200 of the display panel may be calculated using a plurality of aging compensation circuits.

In the present disclosure, the display panel further includes scan gate lines G1. As shown in FIG. 3, the scan gate lines G1 are in one-to-one correspondence with the multiple rows of pixel circuits 200 respectively.

In the embodiment of the present disclosure, the aging degrees of the light-emitting diodes in the plurality of pixel circuits 200 can be periodically detected.

When the aging degrees of the light-emitting diodes in the plurality of pixel circuit 200 are detected, the scan gate lines G1 may be scanned row by row, the detection gate lines G2 may be scanned row by row, and the source driving circuit 400 may supply data signals to corresponding data lines Data respectively. The currents generated when the parasitic capacitors of the corresponding light-emitting diodes OLED are charged are output to the corresponding aging compensation circuits through the corresponding detection output lines 300 respectively.

In the present disclosure, the structure of the pixel circuit 200 is not particularly limited here. For example, in the embodiments shown in FIG. 1 to FIG. 3, the pixel circuit 200 may be a 2T1C circuit, which may include a driving transistor T3, a switch transistor T1, and a pixel storage capacitor Cst. A gate electrode of the switch transistor T1 is electrically coupled to a corresponding scan gate line G1, a first electrode of the switch transistor T1 is electrically coupled to a corresponding data line Data, and a second electrode of the switch transistor T1 is electrically coupled to one terminal of the pixel storage capacitor Cst. A gate electrode of the driving transistor T3 is electrically coupled to the second electrode of the switch transistor T1, a first electrode of the driving transistor T3 is electrically coupled to a high level terminal Vdd, and a second electrode of the driving transistor T3 is electrically coupled to the anode of the light-emitting diode OLED. The switch transistor T1 may be turned on when a first scan signal is received, and may be turned off when a second scan signal having a phase opposite to that of the first scan signal is received.

When the gate electrode of the switch transistor T1 receives the first scan signal, the switch transistor T1 is turned on. The pixel storage capacitor Cst may store a voltage written through the data line Data. The driving transistor T3 may generate a current for driving the light-emitting diode OLED to emit light under the driving of the voltage stored in the pixel storage capacitor Cst.

In the present disclosure, the structure of the detection controller 160 is not particularly limited here. In an embodiment, the detection controller 160 may include a detection control transistor T2. A gate electrode of the detection control transistor T2 serves as a control terminal of the detection controller 160, a first electrode of the detection control transistor T2 serves as an input terminal of the detection controller 160, and a second electrode of the detection control transistor T2 serves as an output terminal of the detection controller 160. The detection control transistor T2 is turned on when the gate electrode of the detection control transistor receives the first detection control signal. The detection control transistor T2 is turned off when the gate electrode of the detection control transistor receives a second detection control signal. The first detection control signal is opposite in phase to the second detection control signal.

The operation (e.g., performing the aging compensation method described below) of the aging compensation circuit in the display panel is described below in conjunction with the embodiment shown in FIG. 3.

During the reset stage, since the initial switch SW0 is turned on, the input terminal of the first current mirror circuit 110 is electrically coupled to the initial reference voltage terminal Vref0 to reset the anode of the organic light-emitting diode OLED. At this time, a first scan signal is applied to the scan gate line G1 to enable the switch transistor T1 to be turned on, and a first detection control signal is applied to the detection gate line G2 to enable the detection control transistor T2 to be turned on. Thereafter, a second scan signal having a phase opposite to that of the first scan signal is applied to the scan gate line G1 to enable the switch transistor T1 to be turned off, and a second detection control signal having a phase opposite to that of the first detection control signal is applied to the detection gate line G2 to enable the detection control transistor T2 to be turned off. At this time, the first switch SW1 is turned on, the second switch SW2 is turned off, and the third switch SW3 is turned off.

During the detection stage, the initial switch SW0 is turned off. The first scan signal is applied to the scan gate line G1 to enable the switch transistor T1 to be turned on. A data voltage is applied to the data line Data, and the first detection control signal is applied to the detection gate line G2 to enable the detection control transistor T2 to be turned on. At this time, each of the switch transistor T1, the detection control transistor T2 and the driving transistor T3 is turned on. Thereafter, the switch transistor T1 and the detection control transistor T2 may be turned off in sequence. The first switch SW1 is turned off, the second switch SW2 is turned on, and the third switch SW3 is turned on. A charging current generated by charging the parasitic capacitor $C_{oled}$ of the light-emitting diode OLED is input to the first current mirror circuit 110 through the detection output line 300, is amplified by the first current mirror circuit 110, then flows into the second current mirror circuit 120, is amplified again by the second current mirror circuit 120 and is output to the inverting terminal of the amplifier 131 in the integration circuit of the voltage converter 130. The integration circuit reflects a change in voltage across the first capacitor C1 at the two terminals of the second capacitor C2, and inputs the change in the form of voltage signal into the analog-to-digital converter 140. The analog-to-digital converter 140 converts the input voltage signal into a digital signal and transmits the digital signal to the compensation value calculation circuit 150.

During the compensation stage, the compensation value calculation circuit 150 determines a data voltage compensation value according to the digital signal output from the analog-to-digital converter 140, and outputs the data voltage compensation value to the source driving circuit 400. The source driving circuit 400 combines the data voltage compensation value with the present uncompensated data voltage and provides the compensated data voltage to a corresponding pixel circuit 200.

Figure 4:
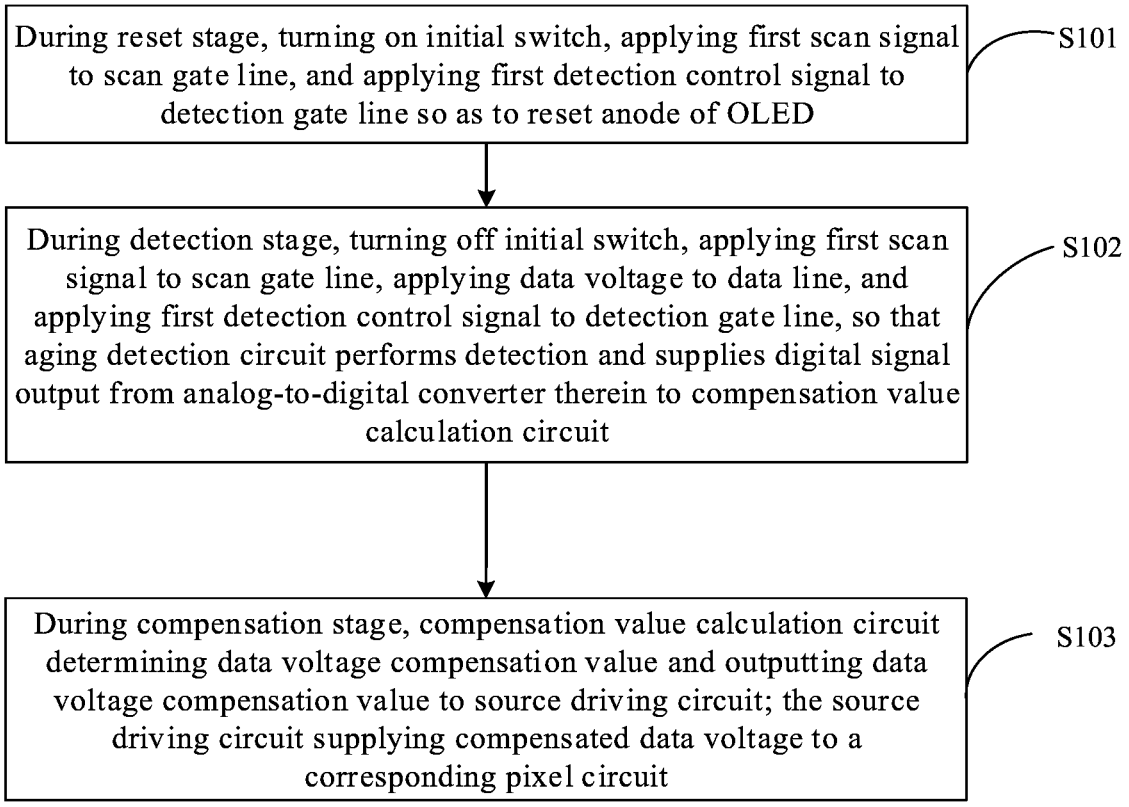
FIG. 4 is a flow chart showing an aging compensation method according to the disclosure.

As a fourth aspect of the present disclosure, an aging detection method is provided. As shown in FIG. 4, the aging detection method may include a reset stage (S101), a detection stage (S102), and a compensation stage (S103).

In an embodiment, during the reset stage, the initial switch SW0 is turned on, a first scan signal is applied to the scan gate line G1, and a first detection control signal is applied to the detection gate line G2 so as to reset the anode of the organic light-emitting diode.

In an embodiment, during the detection stage, the initial switch SW0 is turned off, the first scan signal is applied to the scan gate line G1, the data voltage is applied to the data line Data, and the first detection control signal is applied to the detection gate line G2, so that the aging detection circuit performs detection and supplies the digital signal output from the analog-to-digital converter 140 therein to the compensation value calculation circuit 150.

In an embodiment, during the compensation stage, the compensation value calculation circuit 150 determines a data voltage compensation value and outputs the data voltage compensation value to the source driving circuit 400. The source driving circuit 400 supplies the compensated data voltage to a corresponding pixel circuit 200.

In an embodiment, during the reset stage, the first switch SW1 is turned on, both of the second switch SW2 and the third switch SW3 are turned off. After the anode is reset, a second scan signal having a phase opposite to that of the first scan signal is applied to the scan gate line G1, and a second detection control signal having a phase opposite to that of the first detection control signal is applied to the detection gate line G2.

In an embodiment, during the detection stage, the first switch SW1 is turned off, and both of the second switch SW2 and the third switch SW3 are turned on.

In an embodiment, during the compensation stage, the compensation value calculation circuit 150 determines the data voltage compensation value according to the digital signal output from the analog-to-digital converter 140 upon expiration of the time set the timer 152. The source driving circuit 400 combines the data voltage compensation value with the present uncompensated data voltage to provide the compensated data voltage to a corresponding pixel circuit 200.

It should be understood that the above embodiments are merely exemplary embodiments for the purpose of illustrating the principles of the present disclosure, but the present disclosure is not limited thereto. It will be apparent to those skilled in the art that various changes and modifications can be made without departing from the essence and spirit of the present disclosure, which are also to be regarded as falling within the scope of the present disclosure.

What is claimed is:

1. An aging detection circuit, comprising a first current mirror circuit, a second current mirror circuit, a voltage converter, and an analog-to-digital converter, wherein an input terminal of the first current mirror circuit is electrically coupled to an initial reference voltage terminal via one initial switch and an anode of a to-be-detected light-emitting diode respectively, an output terminal of the first current mirror circuit is electrically coupled to an input terminal of the second current mirror circuit, and a power input terminal of the first current mirror circuit is electrically coupled to a first reference voltage terminal, an output terminal of the second current mirror circuit is electrically coupled to an input terminal of the voltage converter, and a power input terminal of the second current mirror circuit is electrically coupled to a third reference voltage terminal, one of the first current mirror circuit and the second current mirror circuit is an N-type current mirror circuit, and the other of the first current mirror circuit and the second current mirror circuit is a P-type current mirror circuit, the voltage converter is configured to convert a current output from the second current mirror circuit into a voltage and output the voltage, and the analog-to-digital converter is configured to convert the voltage signal output from the voltage converter into a digital signal, one terminal of the initial switch is directly and only coupled to the initial reference voltage terminal, and another terminal of the initial switch is directly and only coupled to the input terminal of the first current mirror circuit.

2. The aging detection circuit according to claim 1, wherein the first reference voltage terminal is a ground terminal, the third reference voltage terminal is a voltage terminal that provides a voltage higher than a voltage of the first reference voltage terminal, the first current mirror circuit is an N-type current mirror circuit, and the second current mirror circuit is a P-type current mirror circuit.

3. The aging detection circuit according to claim 2, wherein the voltage converter comprises an integration circuit, a second switch, a second capacitor, and a third switch, the integration circuit comprises an amplifier, a first capacitor and a first switch, an inverting input terminal of the amplifier serves as the input terminal of the voltage converter, and a non-inverting input terminal of the amplifier is coupled to a second reference voltage terminal, one terminal of the first capacitor is coupled to the inverting input terminal of the amplifier, and the other terminal of the first capacitor is coupled to an output terminal of the amplifier, one terminal of the first switch is electrically coupled to the one terminal of the first capacitor, and the other terminal of the first switch is electrically coupled to the other terminal of the first capacitor, one terminal of the second capacitor is coupled between the second switch and the third switch, and the other terminal of the second capacitor is electrically coupled to the first reference voltage terminal, and one terminal of the third switch is coupled to the second switch and the second capacitor, and the other terminal of the third switch serves as an output terminal of the voltage converter.

4. The aging detection circuit according to claim 2, wherein the first current mirror circuit comprises a first N-type current mirror transistor and a second N-type current mirror transistor, a gate electrode of the first N-type current mirror transistor is electrically coupled to a gate electrode of the second N-type current mirror transistor, a first electrode of the first N-type current mirror transistor serves as an input terminal of the aging detection circuit, a second electrode of the first N-type current mirror transistor serves as the power input terminal of the first current mirror circuit, and the first electrode of the first N-type current mirror transistor is electrically coupled to the gate electrode of the first N-type current mirror transistor, and a first electrode of the second N-type current mirror transistor serves as the output terminal of the first current mirror circuit, and a second electrode of the second N-type current mirror transistor is electrically coupled to the second electrode of the first N-type current mirror transistor.

5. The aging detection circuit according to claim 2, wherein the second current mirror circuit comprises a first P-type current mirror transistor and a second P-type current mirror transistor, a gate electrode of the first P-type current mirror transistor is electrically coupled to a gate electrode of the second P-type current mirror transistor, a first electrode of the first P-type current mirror transistor serves as the input terminal of the second current mirror circuit, a second electrode of the first P-type current mirror transistor serves as the power input terminal of the second current mirror circuit, and the first electrode of the first P-type current mirror transistor is electrically coupled to the gate electrode of the first P-type current mirror transistor, and a first electrode of the second P-type current mirror transistor serves as the output terminal of the second current mirror circuit, and a second electrode of the second P-type current mirror transistor is electrically coupled to the second electrode of the first P-type current mirror transistor.

6. The aging detection circuit according to claim 2, wherein the second current mirror circuit comprises a first P-type current mirror transistor, a second P-type current mirror transistor, a third P-type current mirror transistor, and a fourth P-type current mirror transistor, a gate electrode of the first P-type current mirror transistor is electrically coupled to a gate electrode of the second P-type current mirror transistor, a first electrode of the first P-type current mirror transistor is electrically coupled to a first electrode of the third P-type current mirror transistor, a second electrode of the first P-type current mirror transistor serves as the power input terminal of the second current mirror circuit, and the gate electrode of the first P-type current mirror transistor is electrically coupled to the first electrode of the first P-type current mirror transistor, a first electrode of the second P-type current mirror transistor is electrically coupled to a first electrode of the fourth P-type current mirror transistor, and a second electrode of the second P-type current mirror transistor is electrically coupled to the second electrode of the first P-type current mirror transistor, a gate electrode of the third P-type current mirror transistor is electrically coupled to a gate electrode of the fourth P-type current mirror transistor, a second electrode of the third P-type current mirror transistor serves as the input terminal of the second current mirror circuit, and the gate electrode of the third P-type current mirror transistor is electrically coupled to the second electrode of the third P-type current mirror transistor, and a second electrode of the fourth P-type current mirror transistor serves as the output terminal of the second current mirror circuit.

7. An aging compensation circuit, comprising a compensation value calculation circuit, a source driving circuit, and an aging detection circuit which is the aging detection circuit according to claim 1, wherein an output terminal of the analog-to-digital converter in the aging detection circuit is electrically coupled to the compensation value calculation circuit the compensation value calculation circuit is configured to determine and output a data voltage compensation value corresponding to a pixel circuit, and the source driving circuit is configured to combine the data voltage compensation value with a present uncompensated data voltage corresponding to the pixel circuit, and provide a compensated data voltage to the pixel circuit.

8. The aging compensation circuit according to claim 7, wherein the compensation value calculation circuit comprises a compensation value calculation sub-circuit and a timer, an input terminal of the timer serves as an input terminal of the compensation value calculation circuit, and an output terminal of the timer is electrically coupled to an input terminal of the compensation value calculation sub-circuit, and the compensation value calculation sub-circuit is configured to determine the data voltage compensation value according to the digital signal output from the analog-to-digital converter upon expiration of a time set in the timer, and output the data voltage compensation value.

9. A display panel, comprising a plurality of pixel circuits arranged in multiple rows and multiple columns, wherein the display panel further comprises:

scan gate lines, in one-to-one correspondence with the multiple rows of pixel circuits respectively, each of the scan gate lines being electrically coupled to switch transistors in pixel circuits in a corresponding row, detection gate lines, in one-to-one correspondence with the multiple rows of pixel circuits respectively, detection output lines, in one-to-one correspondence with the multiple columns of pixel circuits respectively, detection controllers, in one-to-one correspondence with the plurality of pixel circuits respectively, wherein a control terminal of the detection controller is electrically coupled to a corresponding detection gate line, an input terminal of the detection controller is electrically coupled to an anode of a light-emitting diode in a corresponding pixel circuit, an output terminal of the detection controller is electrically coupled to a corresponding detection output line, and the detection controller is configured to be turned on upon receipt of a first detection control signal, and aging compensation circuits, in one-to-one correspondence with the multiple columns of pixel circuits respectively, wherein each of the aging compensation circuits is the aging compensation circuit according to claim 8, an output terminal of the aging compensation circuit is electrically coupled to the source driving circuit of the display panel, and the input terminal of the first current mirror circuit of the aging compensation circuit is electrically coupled to a corresponding detection output line, wherein the source driving circuit is configured to combine data voltage compensation values corresponding to the plurality of pixel circuits with corresponding present uncompensated data voltages, and provide compensated data voltages to the plurality of pixel circuits respectively.

10. The display panel according to claim 9, wherein the detection controller comprises a detection control transistor, a gate electrode of the detection control transistor serves as the control terminal of the detection controller, a first electrode of the detection control transistor serves as the input terminal of the detection controller, and a second electrode of the detection control transistor serves as the output terminal of the detection controller, the detection control transistor is turned on when the gate electrode of the detection control transistor receives the first detection control signal, and the detection control transistor is turned off when the gate electrode of the detection control transistor receives a second detection control signal having a phase opposite to a phase of the first detection control signal, and the switch transistors are turned on when a first scan signal is received, and the switch transistors are turned off when a second scan signal having a phase opposite to a phase of the first scan signal is received.

11. An aging compensation method for the aging compensation circuit according to claim 7, comprising:

during a reset stage, turning on the initial switch between the input terminal of the first current mirror circuit and the initial reference voltage terminal, applying a first scan signal to a scan gate line, and applying a first detection control signal to a detection gate line so as to reset the anode of the to-be-detected organic light-emitting diode in the pixel circuit;

during a detection stage, turning off the initial switch, providing the first scan signal to the scan gate line, applying a data voltage to a data line, and applying the first detection control signal to the detection gate line, so that the aging detection circuit performs detection and provides the digital signal output from the analog-to-digital converter in the aging detection circuit to the compensation value calculation circuit; and during a compensation stage, determining, by the compensation value calculation circuit, the data voltage compensation value and outputting the data voltage compensation value to the source driving circuit, and applying, by the source driving circuit, the compensated data voltage to the pixel circuit.

12. The aging compensation method according to claim 11, further comprising:

during the reset stage, turning on a first switch in the voltage converter, and turning off both of a second switch and a third switch in the voltage converter; and after the anode is reset, applying a second scan signal having a phase opposite to a phase of the first scan signal to the scan gate line, and applying a second detection control signal having a phase opposite to a phase of the first detection control signal to the detection gate line.

13. The aging compensation method according to claim 11, further comprising: during the detection stage, turning off a first switch in the voltage converter, and turning on both of a second switch and a third switch in the voltage converter.

14. The aging compensation method according to claim 11, further comprising:

during the compensation stage, determining, by the compensation value calculation circuit, the data voltage compensation value according to the digital signal output from the analog-to-digital converter upon expiration of a time set in of a timer of the compensation value calculation circuit; and combining, by the source driving circuit, the data voltage compensation value with the present uncompensated data voltage to provide the compensated data voltage to the pixel circuit.

* * * * *